US009997314B2

(12) United States Patent
Uchii et al.

(10) Patent No.: US 9,997,314 B2
(45) Date of Patent: Jun. 12, 2018

(54) GAS CIRCUIT BREAKER

(71) Applicant: Kabushiki Kaisha Toshiba, Minato-ku (JP)

(72) Inventors: Toshiyuki Uchii, Yokohama (JP); Takanori Iijima, Yokohama (JP); Takato Ishii, Ohta (JP); Hiroshi Furuta, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days. days.

(21) Appl. No.: 15/085,011

(22) Filed: Mar. 30, 2016

(65) Prior Publication Data

US 2016/0211097 A1 Jul. 21, 2016

Related U.S. Application Data

(63) Continuation of application No. PCT/JP2014/005194, filed on Oct. 14, 2014.

(30) Foreign Application Priority Data

Oct. 16, 2013 (JP) ..... 2013-215861

(51) Int. Cl.
*H01H 33/91* (2006.01)
*H01H 33/90* (2006.01)
(Continued)

(52) U.S. Cl.
CPC ..... *H01H 33/91* (2013.01); *H01H 33/12* (2013.01); *H01H 33/56* (2013.01);
(Continued)

(58) Field of Classification Search
CPC ..... H01H 33/56; H01H 33/60; H01H 33/64; H01H 33/72; H01H 33/90; H01H 33/91;
(Continued)

(56) References Cited

U.S. PATENT DOCUMENTS 4,550,330 A 10/1985 Fowler
5,258,590 A * 11/1993 Dufournet ..... H01H 33/91 218/63
(Continued)

FOREIGN PATENT DOCUMENTS

CN 1232280 A 10/1999
CN 1259753 A 7/2000
(Continued)

OTHER PUBLICATIONS

International Search Report dated Jan. 13, 2015 in PCT/JP2014/005194 filed on Oct. 14, 2014 (with English translation).
(Continued)

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

The gas circuit breaker includes a sealed container filled with an arc-extinguishing gas, a pair of fixed arc electrodes arranged in the sealed container to be opposite to each other, a trigger electrode movably arranged between the fixed arc electrodes and generating an arc discharge according to movement, a pressurization chamber pressuring and increasing a pressure of the arc-extinguishing gas with pressurization means, and a pressure accumulation chamber in communication with the pressurization chamber and accumulating the pressurized arc-extinguishing gas. The trigger electrode switches the pressure accumulation chamber into a closed state or an open state. The pressure accumulation chamber is switched to the closed state in a first half of breaking of the electric current, and the pressure accumulation chamber is switched to the open state in a latter half of breaking of the electric current. The arc-
(Continued)

extinguishing gas in the pressure accumulation chamber is guided to the arc discharge.

12 Claims, 4 Drawing Sheets

(51) Int. Cl.
*H01H 33/56* (2006.01)
*H01H 33/12* (2006.01)
*H01H 33/70* (2006.01)
*H01H 33/88* (2006.01)

(52) U.S. Cl.
CPC ..... *H01H 33/7023* (2013.01); *H01H 33/90* (2013.01); *H01H 33/903* (2013.01); *H01H 2033/888* (2013.01); *H01H 2033/908* (2013.01)

(58) Field of Classification Search
CPC ..... H01H 33/901; H01H 33/7023; H01H 33/903; H01H 33/12; H01H 33/70
USPC ..... 218/57, 63, 60, 61, 65, 68, 89, 53, 62
See application file for complete search history.

(56) References Cited

U.S. PATENT DOCUMENTS 5,285,036 A * 2/1994 Lorenz ..... H01H 33/905 218/61
5,844,189 A * 12/1998 Niemeyer ..... H01H 33/7015 218/29
5,905,243 A * 5/1999 Zehnder ..... H01H 33/901 218/54
6,163,001 A 12/2000 Zehnder et al.
6,489,581 B2 * 12/2002 Ozil ..... H01H 33/905 218/61
8,115,133 B2 * 2/2012 Uchii ..... H01H 33/7076 218/63
2015/0194280 A1 * 7/2015 Uchii ..... H01H 33/91 218/52

FOREIGN PATENT DOCUMENTS

| | | | |
|---|---|---|---|
| CN | 101826414 | A | 9/2010 |
| CN | 104662634 | A | 5/2015 |
| DE | 195 17 615 | A1 | 11/1996 |
| EP | 0 836 209 | A2 | 4/1998 |
| EP | 2 903 013 | A1 | 8/2015 |
| FR | 2 692 400 | | 12/1993 |
| JP | 61-14444 | U | 1/1986 |
| JP | 11-329191 | | 11/1999 |
| JP | 2000-348580 | | 12/2000 |
| JP | 2002-203463 | | 7/2002 |
| JP | 2014-72032 | | 4/2014 |
| JP | 2015-185381 | | 10/2015 |
| JP | 2015-185467 | | 10/2015 |

OTHER PUBLICATIONS

Written Opinion dated Jan. 13, 2015 in PCT/JP2014/005194 filed on Oct. 14, 2014.
Combined Chinese Office Action and Search Report dated Mar. 20, 2017 in Patent Application No. 201480056753.2 (with English Translation of Category of Cited Documents).
Extended European Search Report dated Jun. 30, 2017 in European Application No. 14854027.1.
International Preliminary Report on Patentability and Written Opinion of the International Searching Authority dated Apr. 28, 2016 in PCT/JP2014/005194 (with English language translation).

* cited by examiner

GAS CIRCUIT BREAKER

CROSS-REFERENCE TO RELATED APPLICATION

This is a Continuation of PCT Application No. PCT/JP2014/005194, filed on Oct. 14, 2014, which is based upon and claims the benefit of priority from the prior Japanese Patent Application No. 2013-215861, filed on Oct. 16, 2013, the entire contents of which are incorporated herein by reference.

FIELD

An embodiment of the present invention relates to a gas circuit breaker for switching (changing over) breaking and turning-on of an electric current in an electric power system.

BACKGROUND

A gas circuit breaker is used when it is required to break an excessively high fault electric current, a low leading (capacitive) current, low lagging (inductive) load current such as a reactor breaking, or an extremely small fault electric current in an electric power system. The gas circuit breaker mechanically separates a contact shoe in the process of breaking, and blows arc-extinguishing gas to eliminate arc discharge generated in the process of breaking.

The gas circuit breaker explained above has a puffer-type, which is currently widely used (for example, Japanese published examined Patent Application No. H7-109744 (hereinafter referred to as Patent Literature 1). The puffer-type gas circuit breaker has an opposing arc contact shoe and an opposing energizing contact shoe and a movable arc contact shoe and a movable energizing contact shoe arranged to oppose each other in a sealed container filled with an arc-extinguishing gas, and causes each of them to be in contact with each other or move away from each other by a mechanical driving force, so that the electric current is passed or cut off.

This gas circuit breaker includes a pressure accumulation space of which capacity decreases as the contact shoe moves away and accordingly the internal arc-extinguishing gas is pressurized and accumulated, and an insulation nozzle arranged to enclose both of the arc contact shoes to guide the arc-extinguishing gas in the pressure accumulation space to the arc. In the process of breaking, the opposing arc contact shoe and the movable arc contact shoe move away from each other, so that an arc is generated between both of the arc contact shoes. As the contact shoe moves away, the arc-extinguishing gas sufficiently pressurized and accumulated in the pressure accumulation space is strongly blown to the arc via the insulation nozzle, so that the insulation performance of both of the arc contact shoes is recovered, whereby the arc is eliminated, and the breaking of the electric current is completed.

A so-called tandem-puffer-type is widely used as a gas circuit breaker capable of effectively breaking any electric current from a small electric current to a large electric current (for example, Japanese published examined Patent Application No. H7-97466 (hereinafter referred to as Patent Literature 2)). In this gas circuit breaker, the pressure accumulation space is divided into two chambers of which pressurization mechanisms are different, in order to improve the breaking performance without increasing the driving energy. More specifically, the gas circuit breaker includes both of the spaces, i.e., a thermal puffer chamber and a mechanical puffer chamber, and generates a strong jet flow by pressurizing the arc-extinguishing gas by using both of the heating pressurization action and the mechanical pressurizing action.

When a large electric current is broken (interrupted), the arc discharge is at an extremely high temperature, and therefore, the ambient arc-extinguishing gas is heated, and with the thermal expansion of this arc-extinguishing gas and the flow into the thermal puffer chamber, the thermal puffer chamber is significantly pressurized. The pressure of this thermal puffer chamber generates a blowing force of the arc-extinguishing gas which is sufficient for eliminating the arc discharge.

On the other hand, when a small electric current is broken, the self pressurization action by the arc discharge is small, and therefore, the increase in the pressure in the thermal puffer chamber with this action cannot be expected. In such case, the tandem-puffer-type gas circuit breaker can also use the feeding of the arc-extinguishing gas from the mechanical puffer chamber to the thermal puffer chamber, and therefore, a blowing pressure for breaking a small electric current can be ensured.

In this case, in a case of an arc of a large electric current in the order of several kilo amperes, e.g., breaking of a fault electric current, the arc is not eliminated even at the zero point of the electric current unless it is after the distance between both of the arc contact shoes is sufficiently open and an appropriate flow channel is formed and after a sufficient blowing pressure is pressurized and accumulated in the pressure accumulation space.

However, in a case of an arc of a small electric current equal to or less than several hundred amperes, e.g., breaking of a low leading (capacitive) current break, the arc can be easily eliminated (extinguished) at the zero point of the electric current even it is immediately after both of the arc contact shoes are open and moved away from each other. Then, depending on the electric current phase, the time for which the arc continues becomes extremely close to zero, and the arc is eliminated immediately after the arc contact shoes are open and moved away from each other, and a recovery voltage is applied from a system while the distance between the arc contact shoes is extremely small. When the restrike (reignition) of the arc occurs between the arc contact shoes because of this recovery voltage, an overvoltage may be generated. The restrike of the arc means a breakdown phenomenon that occurs after a time equal to or more than one-fourth of the cycle elapses after the zero point of the electric current with a commercial frequency voltage.

The insulation breakdown between the arc contact shoes may jeopardize the reliability of the system device, and therefore, in general, a gas circuit breaker is required to have a quick insulation recovery property (characteristic) sufficient for avoiding the restrike of the arc. In order to satisfy the demand, in general, it is necessary to alleviate an electric field at the tip (end) of the arc contact shoe, or it is necessary to improve the speed at a point in time when both of the arc contact shoes open and move away from each other, and more specifically, it is necessary to improve the contact parting speed, thus ensuring quick insulation recovery between arc contact shoes.

However, when a higher speed is supported by increasing the operation force, there is a problem in that the size of the driving device becomes larger, or the weight of the movable contact shoe unit increases in order to increase the mechanical strength, and it is necessary to further increase the driving energy.

Therefore, a technique has been suggested to connect a driving device and a movable contact shoe unit via a fixed cam mechanism, and drive a link joined with the movable contact shoe unit along the shape of the groove of the cam, thus improving the speed after the contact parting (for example, Japanese Patent Application Laid-Open No. 2004-55420 (hereinafter referred to as Patent Literature 3)). A technique has also been suggested to provide a rotation groove cam between a driving device and a movable contact shoe unit, thereby reducing the moving distance of the movable contact unit and the movable unit at the driving device side and efficiently reducing the driving energy (for example, Japanese Patent Application Laid-Open No. 2002-208336 (hereinafter referred to as Patent Literature 4)).

However, a conventional gas circuit breaker involves the following problem, and solving this problem is desired.

(A) Temperature of Blown Gas

In a conventional gas circuit breaker, the arc-extinguishing gas of which temperature has been raised by the arc discharge is retrieved into a puffer chamber or a thermal puffer chamber, and therefore, the high temperature arc-extinguishing gas is blown to the arc discharge. As a result, the cooling efficiency for cooling the arc discharge is reduced, and the breaking performance may decrease.

(B) Effect to Durability and Maintenance Caused by the Temperature of Blown Gas

When the high temperature arc-extinguishing gas is blown to the arc discharge, the temperature around the arc discharge is also raised. As a result, the arc electrode and the insulation nozzle are subjected to high temperature and are likely to be degraded (deteriorated), and accordingly, it is necessary to frequently perform maintenance. This is contrary to the needs of the users who seek the improvement of the durability and the reduction of the maintenance.

(C) Electric Current Breaking Time

Further, it takes a certain amount of time to increase the pressure in the puffer chamber and the thermal puffer chamber. For this reason, it may take a long time to complete breaking of the electric current. The gas circuit breaker is a device for quickly breaking an excessively high fault electric current in an electric power system, and therefore, from the perspective of the basic function of the gas circuit breaker, it is always required to reduce the time until the breaking of the electric current is completed.

(D) Driving Operation Force

In order to reduce the driving operation force in the gas circuit breaker, it is important to achieve the simplification of the configuration and reduce the weight. For example, in a tandem-puffer-type gas circuit breaker obtained by dividing the puffer chamber into two parts, additional components such as a diaphragm (partition plate) and a check valve, and therefore, the structure becomes more complicated, and the weight of the movable portion tends to increase. When the weight of the movable portion increases, a stronger driving operation force is needed in order to obtain the same separation speed. More specifically, in a conventional tandem-puffer-type gas circuit breaker, the configuration is required to be simplified in order to reduce the weight of the movable portion.

(E) How Gas Flows

Further, in the puffer-type gas circuit breaker for blowing the arc-extinguishing gas to the arc discharge, stabilization of the flow of the arc-extinguishing gas in the device is also regarded as important. In particular, in the tandem-puffer-type gas circuit breaker, the flow of the arc-extinguishing gas is likely to become unstable, and the improvement thereof is desired.

(F) Break Performance During High Speed Reclosing Operation

Further, in the gas circuit breaker, needless to say, the breaking performance during the high speed reclosing operation is required to be excellent, but in the tandem-puffer-type gas circuit breaker, the breaking performance during the high speed reclosing operation may be low, which has become a problem.

A gas circuit breaker according to the present embodiment is suggested to solve the above problems. More specifically, it is an object of the gas circuit breaker according to the present embodiment to provide a gas circuit breaker that reduces the temperature of a blown gas, improves the durability, reduces the maintenance, reduces the time it takes to break an electric current, reduces a driving operation force, stabilize the flow of an arc-extinguishing gas, and further, improves the breaking performance during high speed reclosing operation.

In order to achieve the above object, the gas circuit breaker according to the present embodiment is a gas circuit breaker for switching breaking and turning-on of an electric current, and is characterized in having the following configuration.

(a) A sealed container filled with an arc-extinguishing gas, (b) A pair of fixed arc electrodes arranged in the sealed container to be opposite to each other, (c) a trigger electrode freely and movably arranged between the fixed arc electrodes and generating an arc discharge according to movement, (d) a pressurization unit pressuring and increasing a pressure of the arc-extinguishing gas with pressurization means, (e) a pressure accumulation unit in communication with the pressurization unit and accumulating the pressurized arc-extinguishing gas, (f) the trigger electrode is open and close means for switching the pressure accumulation unit into a closed state or an open state, and the pressure accumulation unit is switched to the closed state in a first half of breaking of the electric current, and the pressure accumulation unit is switched to the open state in a latter half (a second half) of breaking of the electric current, so that the arc-extinguishing gas in the pressure accumulation unit is guided to the arc discharge.

DETAILED DESCRIPTION OF THE PREFERRED EMBODIMENTS

1. First Embodiment (Overall Configuration)

Figure 1A:
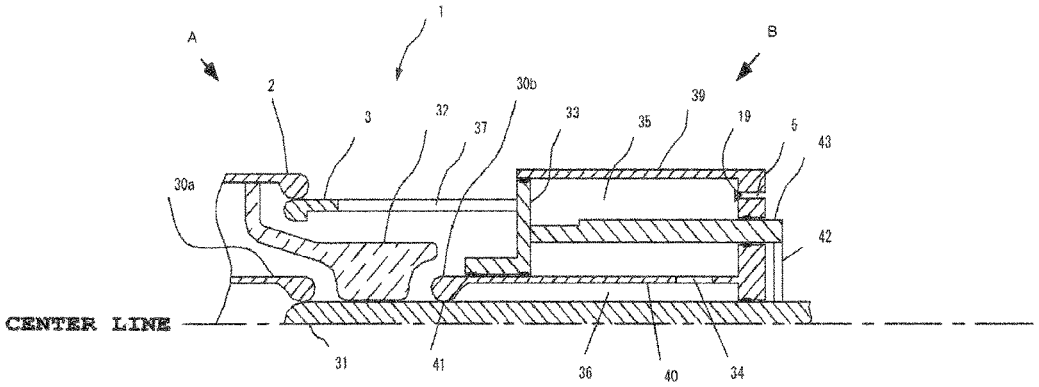
FIGS. 1A to 1C are cross sectional views illustrating an entire configuration of a gas circuit breaker according to a first embodiment, and is a cross sectional view illustrating the states of the turn-on, the first half of breaking, and the latter half of breaking.
Figure 1B:
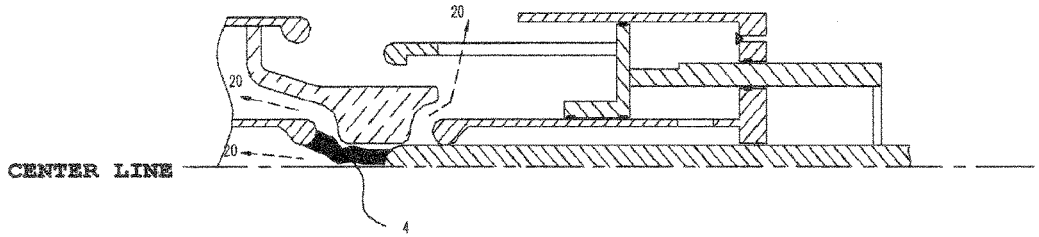
Figure 1C:
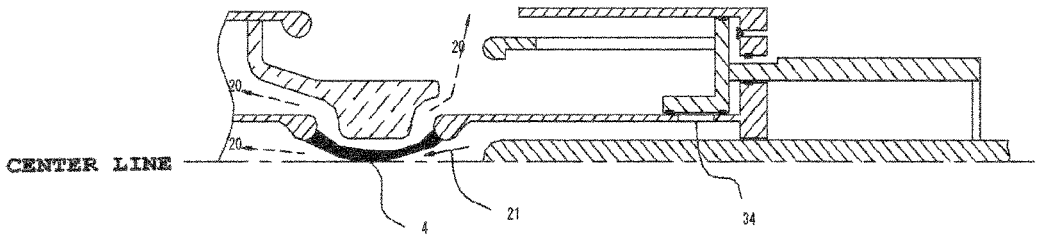

Hereinafter, a gas circuit breaker according to the first embodiment will be explained with reference to FIGS. 1A, 1B, 1C, 2 and 3. The gas circuit breaker causes electrodes constituting an electric path to be in contact with each other and to be away from each other, thus switching the open state and the closed state of the electric current. In the process of breaking the electric current, the electrodes are bridged by arc discharge. In the process of breaking the electric current, a gas flow of arc-extinguishing gas is generated, and the gas flow is blown to the arc discharge by guiding the gas flow thereto, so that the arc discharge is cooled, and the arc is eliminated at the zero point of the electric current.

The gas circuit breaker includes a sealed container (not shown) filled with the arc-extinguishing gas. The sealed container is made of metal, an insulator, or the like, and is grounded. The arc-extinguishing gas is a gas having a high arc-extinguishing performance and insulation performance such as sulfur hexafluoride (sulfur) gas ($SF_6$ gas), air, carbon dioxide, oxygen, nitrogen, mixed gas thereof, or others. Desirably, the arc-extinguishing gas is a gas of which global warming coefficient is less than that of the sulfur hexafluoride gas, of which molecular weight is less than that of the sulfur hexafluoride gas, and which is in a gas phase at least when the pressure is equal to or more than one atm and the temperature is equal to or less than 20 degrees Celsius, or a mixed gas thereof.

The electrodes of the gas circuit breaker are roughly divided into an opposing electrode unit A and a movable electrode unit B, and are arranged in the sealed container in such a manner that the opposing electrode unit A and the movable electrode unit B are opposite to each other. Each of the opposing electrode unit A and the movable electrode unit B is mainly constituted by multiple members which are basically hollow cylinders or solid pillars, and is arranged in a coaxial manner having a common central axis, so that when the diameters are caused to be the same, related members function in a cooperating manner with each other while the related members are opposite to each other.

The opposing electrode unit A includes a fixed arc electrode 30*a* and a fixed energizing electrode 3. The movable electrode unit B includes a fixed arc electrode 30*b*, a movable energizing electrode 3, and a trigger electrode 31.

The pair of fixed arc electrodes 30*a*, 30*b* are not members included in the movable portion constituted by the movable energizing electrode 3, the trigger electrode 31, the movable piston 33, and the like, but are members fixed to the inside of the sealed container (not shown). On the other hand, the movable portion constituted by the movable energizing electrode 3, the trigger electrode 31, the movable piston 33, and the like which are movable elements of the movable electrode unit B is directly or indirectly coupled with a driving device (not shown), and comes into contact with or moves away from the opposing electrode unit A in accordance with operation force of the driving device.

Therefore, the movable electrode unit B comes into contact with or moves away from opposing electrode unit A, so that turning-on and breaking of the electric current is realized, and generation and elimination of an arc discharge 4 is realized. In normal operation, the pressure inside of the sealed container is a single pressure, e.g., filling pressure of the arc-extinguishing gas, at any of the portions thereof.

The opening edges of the fixed arc electrodes 30*a*, 30*b* are bulging to the inside, and the inner diameter of the opening edge portion is the same as the external diameter of the trigger electrode 31 in a rod shape. When the trigger electrode 31 is inserted into the fixed arc electrode 30*a*, the inner surface of the fixed arc electrode 30*a* and the outer surface of the trigger electrode 31 come into contact with each other, so that electrically conductive state is attained. Likewise, the inner surface of the fixed arc electrode 30*b* and the outer surface of the trigger electrode 31 come into contact with each other, so that electrically conductive state is attained. The trigger electrode 31 freely move between an energizing position where the fixed arc electrodes 30*a*, 30*b* are energized and a breaking position where it is away from the fixed arc electrode 30*a*, so that the generation of the arc discharge 4 is received. The movement of the trigger electrode 31 is made along the central axis by an operation force of the driving device (not shown).

When the trigger electrode 31 is located at the energizing position, the trigger electrode 31 comes into contact with the fixed arc electrodes 30*a*, 30*b*. More specifically, the fixed arc electrodes 30*a*, 30*b* are short-circuited by the trigger electrode 31, whereby an energizing state is attained. When the trigger electrode 31 moves from the energizing position to the breaking position, the trigger electrode 31 moves away from the fixed arc electrode 30*a*, and the arc discharge 4 is generated between the trigger electrode 31 and the fixed arc electrode 30*a*. When the trigger electrode 31 further moves away from the fixed arc electrode 30*a*, and the distance between the fixed arc electrode 30*a* and the trigger electrode 31 becomes wider than the distance between the fixed arc electrode 30*a* and the fixed arc electrode 30*b*, then, the arc discharge 4 ultimately moves from the trigger electrode 31 to the arc electrode 30*b*.

The insulation nozzle 32 is arranged so as to enclose the trigger electrode 31 in a rod shape. The insulation nozzle 32 is provided in a space between the fixed arc electrodes 30*a*, 30*b*. This insulation nozzle 32 is a fixed component that does not move even during the breaking operation. During the breaking operation, the trigger electrode 31 is configured to move inside of the insulation nozzle 32, so that the arc discharge 4 is generated inside of the insulation nozzle 32.

The gas flow blown to the arc discharge 4 is generated by a pressurization chamber 35 and a pressure accumulation chamber 36. The pressure accumulation chamber 36 and the pressurization chamber 35 are provided in the movable electrode unit B, and is provided to enclose the trigger electrode 31. A space made by enclosing the trigger electrode 31 with the cylindrical member 40 and the fixed arc electrode 30*b* is defined as the pressure accumulation chamber 36.

The distal end portion of the fixed arc electrode 30*b* protrudes to the central portion side, and the inner diameter of the distal end portion is equal to the external diameter of the trigger electrode 31, and the trigger electrode 31 slides on the fixed arc electrode 30*b*. A portion where the trigger electrode 31 and the fixed arc electrode 30*b* slide has a certain level of airtightness. The trigger electrode 31 causes the pressure accumulation chamber 36 to be in a closed state. On the other hand, when the trigger electrode 31 moves in a direction away from the fixed arc electrode 30*a*, the trigger electrode 31 also moves away from the fixed arc electrode 30*b*. Therefore, the pressure accumulation chamber 36 attains an open state. More specifically, the trigger electrode 31 is open and close means for switching the pressure accumulation chamber 36 into the closed state and the open state.

Figure 2:
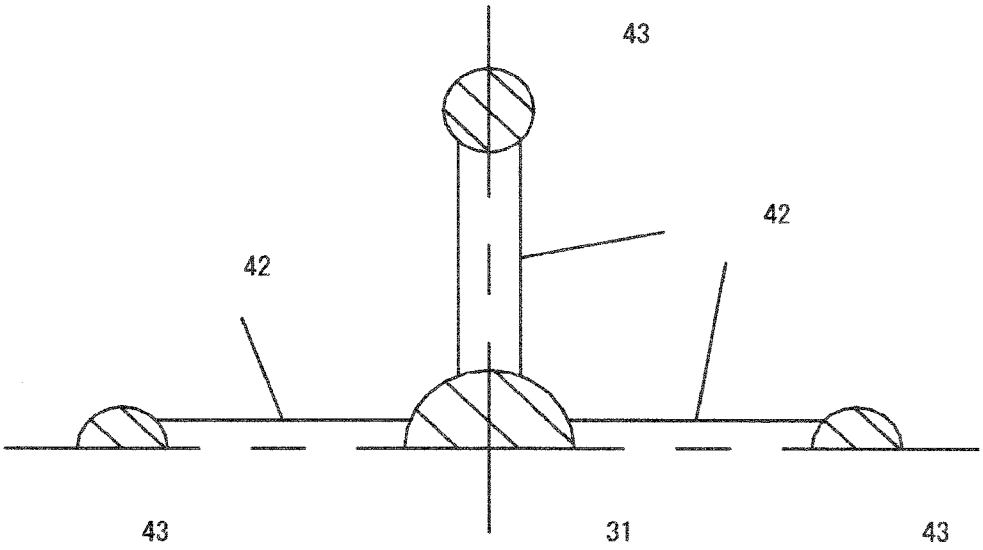
FIG. 2 is a cross sectional view illustrating a rod according to the first embodiment.

The space enclosed by the cylinder 39, the cylindrical member 40, and the movable piston 33 is defined as the pressurization chamber 35. The movable piston 33 is slidably arranged in the cylinder 39 so as to change the capacity of the pressurization chamber 35. When the movable piston 33 moves away from the arc discharge 4 by the operation force of the driving device (not shown), the pressure in the pressurization chamber 35 increases. The movable piston 33 is driven by a rod 43 coupled with, e.g., the trigger electrode 31 and a link 42. Multiple rods 43 are preferably provided in angular directions as shown in FIG. 2 in order to prevent the axis from being deviated and prevent an excessively high mechanical force to be concentrated on a single portion.

The pressurization chamber 35 is sealed by the seal member 47 so that the pressure in the pressurization chamber 35 does not leak out from the slide portion of the rod 43 and the cylinder 39.

(Action)

(Energizing State)

In the energizing state, the opposing energizing electrode 2 and the movable energizing electrode 3 are electrically connected, and these members become one of electric paths. Although not particularly shown in the drawings, in the sealed container 60, two conductive bodies are respectively fixed to the side of the opposing electrode unit A and the side of the movable electrode unit B by spacers. The spacer insulates the sealed container 60 and the conductive body, and also supports the conductive body. In the energizing (conductive) state, the electric current flows via a bushing (not shown) into the gas circuit breaker, and flows from the conductive body at the side of the opposing electrode unit A via the member serving as the electric path, the conductive body at the side of the movable electrode unit B, and the bushing (not shown) to the outside of the gas circuit breaker.

(First Half of Breaking Process)

When it is necessary to break an excessively high fault electric current, a low leading (capacitive) current, a low lagging (inductive) load current such as a reactor break, or an extremely small fault electric current, the trigger electrode 31 receives the operation force of the driving device and moves away from the fixed arc electrode 30*a*, and at the same time, the arc discharge 4 is generated between the trigger electrode 31 and the fixed arc electrode. The hot gas (exhaust heat gas) 20 generated from the arc discharge 4 flows in a direction away from the arc discharge 4 without delay at the same time as the generation thereof. More specifically, the hot gas 20 passes an exhaust hole (not shown) provided in the fixed arc electrode 30*a* and an exhaust hole 37 provided in the movable energizing electrode 3, and is discharged into the sealed container.

More specifically, most of the exhaust heat gas 20 of which temperature is raised by the heat of the arc discharge 4 is discharged into the sealed container, and therefore, the flow into the pressure accumulation chamber 36 is extremely small. Therefore, in a very short time during the breaking operation, the pressurization of the arc-extinguishing gas is hardly affected by the heat of the arc, and is almost achieved by heat insulated pressurizing action (adiabatic compressive action) with the movable piston 33.

(The Latter Half of the Breaking Process)

Figure 3:
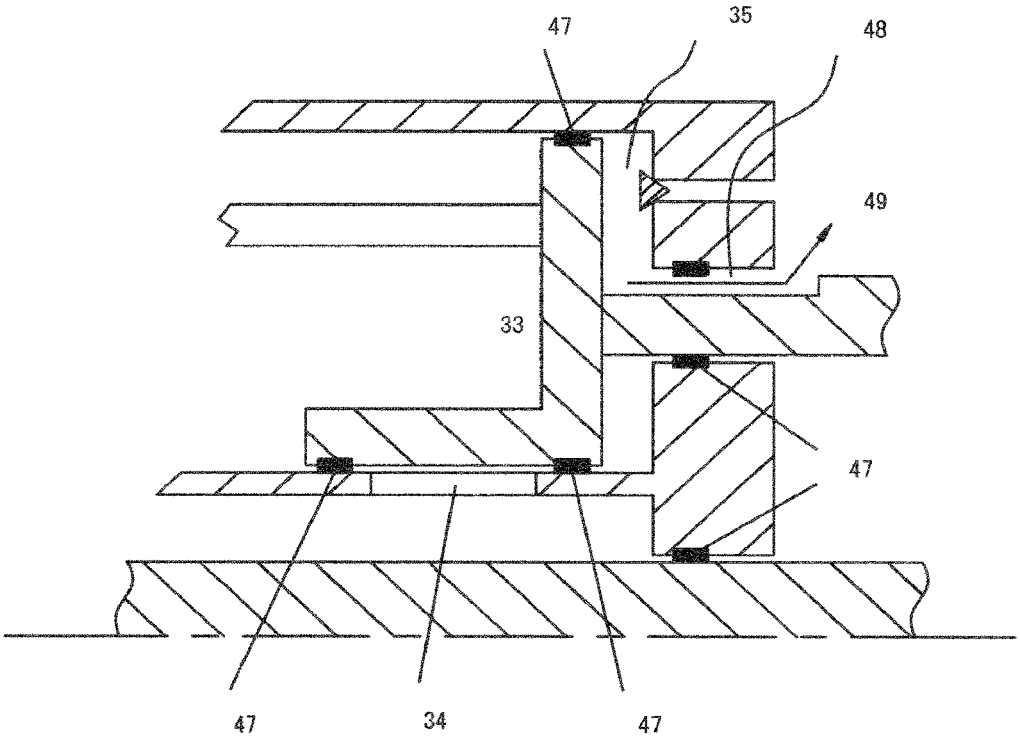
FIG. 3 is a cross sectional view illustrating a structure around a movable piston according to the first embodiment.

In the latter half of the breaking process, the volume of the pressurization chamber 35 becomes relatively small, and most of the arc-extinguishing gas pressurized by the movable piston 33 is accumulated in the pressure accumulation chamber 36. At the same time, the seal member 47 provided in the movable piston 33 seals the communication hole 34, so that the pressurization chamber 35 and the pressure accumulation chamber 36 are separated in terms of pressure. Further, thereafter, the pressure in the pressurization chamber 35 is quickly released to the sealed container by a pressure release mechanism (pressure discharge mechanism) 48. As shown in FIG. 3, the pressure release mechanism 48 may be a groove provided on a part of the rod 43, but various other structures may be considered.

On the one hand, the trigger electrode 31 passes the fixed arc electrode 30*b* so that the closed portion 41 is opened, the pressurized gas in the pressure accumulation chamber 36 is strongly blown to the arc discharge 4 as the blown gas 21. The insulation nozzle 32 appropriately adjust the flow of the gas so that the blown gas 21 is effectively blown to the arc discharge 4, and the hot gas 20 is smoothly discharged.

At this stage, the arc discharge 4 moves on to the fixed arc electrode 30*a*. Therefore, a period in which the arc discharge 4 is occurring (igniting) on the trigger electrode 31 is only a limited period at the first of the breaking process until the arc discharge 4 moves on to the fixed arc electrode 30*b*.

(After Finish of Breaking Process)

The pressurization chamber 35 is provided with an intake hole 5 and an intake valve 19. The intake valve 5 is configured to take in and supply the arc-extinguishing gas into the pressurization chamber 35, only when the pressure in the pressurization chamber 35 becomes less than the filling pressure in the sealed container.

Therefore, when the turn-on operation is performed again after the breaking process is finished, fresh arc-extinguishing gas is supplied from the sealed container via the intake hole 5 to the pressurization chamber 35.

(a) Cooling of Temperature of Blown Gas

The gas circuit breaker according to the present embodiment does not use self pressurization action of the arc-extinguishing gas with the heat of the arc discharge 4. The gas 21 blown to the arc discharge 4 is not thermally pressurized by the heat of the arc discharge 4, and is an arc-extinguishing gas of which pressure is enhanced by the mechanical pressurizing with the movable piston 33. Therefore, the temperature of the pressurization gas 35 blown to the arc discharge 4 is greatly lower than the temperature of a conventional blown gas 21 using self pressurization action. As a result, the cooling effect of the arc discharge 4 by blowing the pressurization gas 35 can be significantly enhanced.

(b) Improvement of Durability and Reduction of Maintenance

In the gas circuit breaker according to the present embodiment, the blown arc-extinguishing gas is of a low temperature. Therefore, the temperature around the arc discharge 4 is cooled. For this reason, the degradation (deterioration) of the fixed arc electrodes 30*a*, 30*b* and the insulation nozzle 32 due to the breaking of the electric current can be significantly reduced, and the durability is improved. As a result, the frequency of maintenance of the fixed arc electrodes 30*a*, 30*b* and the insulation nozzle 32 can be reduced, and the burden of maintenance can be reduced.

The arc electrodes 30*a*, 30*b* fixed to the side of the sealed container do not affect the weight of the movable portion, and therefore, the fixed arc electrodes 30*a*, 30*b* can be thickened without worrying about the increase of the weight. Therefore, the durability of the arc electrodes 30*a*, 30*b* against a large electric current arc is significantly improved. Further, when the arc electrodes 30*a*, 30*b* are configured to be thick, this can greatly alleviate the concentration of the electric field to the tips (ends) of the arc electrodes 30*a*, 30*b* when a high voltage is applied to an electrode gap.

Therefore, as compared with a conventional gas circuit breaker, a required electrode gap interval can be reduced. As a result, the length of the arc discharge 4 decreases, and during the electric current break, an electric input power into the arc discharge 4 decreases.

(c) Reduction of Electric Current Breaking Time

According to the present embodiment, the self pressurization action according to the arc heat is not used, and therefore, the pressure and the flow rate of the pressurized gas blown to the arc discharge 4 are always constant regardless of an electric current condition. A timing when the blowing to the arc discharge 4 is started is also determined by a timing when the distal end portion of the trigger electrode 31 passes the fixed arc electrode 30*b* and both of them move away from each other, and therefore, it is always constant regardless of the electric current condition. Therefore, the time to complete the breaking of the electric current does not increase, and the demand for reducing the time to complete the breaking of the electric current can be satisfied.

(d) Reduction of Driving Operation Force

As the driving stroke comes close to complete breaking position, the pressure of the pressurized gas in the pressurization chamber 35 and the pressure accumulation chamber 36 increases, and at the same time, the pressurizing counterforce applied to the movable piston 33 increases. In order to overcome this, a driving device having an adequate driving force is required.

At the complete breaking position, the seal member 47 provided in the movable piston 33 seals the communication hole 34, so that the pressurization chamber 35 and the pressure accumulation chamber 36 are separated in terms of pressure. At the same time, as shown in FIG. 3, the pressure in the pressurization chamber 35 is released by the pressure release mechanism 48. For this reason, as long as there is a driving energy capable of pulling the movable portion to at least the complete breaking position, no force is thereafter applied to the movable piston 33 to reverse the stroke, and therefore, the stroke move reversely.

The trigger electrode 31 has a diameter smaller than the fixed arc electrodes 30*a*, 30*b*, and is lighter than a conventional movable arc electrode 4 and a conventional driving rod 6. Not only the two fixed arc electrodes 30*a*, 30*b* but also the insulation nozzle 32 is not included in the movable portion, and therefore, the weight of the movable portion can be greatly reduced. As described above, in the present embodiment in which the movable portion is made to be lighter, the driving operation force can be greatly reduced when the contact parting speed of the movable portion required for breaking the electric current is obtained.

Further, when not only the weight is reduced but also the blowing pressure itself required to break the electric current can be reduced, the driving operation force required for pressurizing can be reduced. In the present embodiment, the temperature of the blown gas 21 is much lower than the conventional case, and therefore, the cooling effect of the arc discharge 4 is significantly enhanced, and the arc discharge 4 can be broken at a lower pressure.

As soon as the hot gas 20 generated from the arc discharge 4 is generated, the hot gas 20 flows in a direction away from the arc discharge 4 without delay, and is quickly discharged to the space in the sealed container. Therefore, the blown gas 21 to the arc discharge 4 flows due to a difference between the pressure at the upstream side, i.e., the pressure of the pressure accumulation chamber 36 and the pressure at the downstream side, i.e., the pressure in proximity to the fixed arc electrode 30*a*. More specifically, when the pressure at the downstream side is high, a sufficient blowing force cannot be obtained even though how much the pressure of the pressure accumulation chamber 36 is enhanced.

According to the present embodiment, as soon as the arc discharge 4 occurs, the pressure of the hot gas 20 is quickly discharged to the sealed container, and therefore, the pressure at the downstream side, i.e., the pressure in proximity to the fixed arc electrode 30*a*, maintains substantially the same value as the filling pressure of the sealed container at all times. Therefore, the blowing pressure required to break the electric current can be reduced, and the driving operation force can be reduced.

In the present embodiment, the low temperature pressurization gas 35 blown out from the inside of the fixed arc electrode 30*b* concentrates on the base portion of the arc discharge 4 located in proximity to the fixed arc electrode 30*b*, and is such that the low temperature pressurization gas 35 is blown in a crossing manner from the inside to the outside. For this reason, the arc can be broken at a lower pressure, and while excellent breaking performance is maintained, the driving operation force can be reduced.

The pressure of the hot gas 20 generated from the arc discharge 4 is quickly discharged to the space in the sealed container as described above, but some of the hot gas 20 may be applied to a surface at the left side of the movable piston 33 as shown in FIG. 1. However, even when the pressure of the hot gas 20 is applied, the pressure can be a force for supporting the pressurizing force with the movable piston 33, but it would never act as a counterforce to at least the driving operation force of the movable piston 33. Even from this perspective, the driving operation force can be reduced (e) Stabilization of Gas Flow Further, in the present embodiment, it is not necessary to have a complicated valve control when, e.g., the pressure in the pressure accumulation chamber 36 is adjusted, and the self pressurization action based on the arc heat is not used to increase the blowing pressure of the arc-extinguishing gas. Therefore, regardless of the break electric current condition, the same blown gas pressure and the same gas flow rate can be obtained stably at all times. Therefore, the instability of the performance does not occur because of the magnitude of electric current being broken.

In the present embodiment, all of the insulation nozzle 32 and the arc electrodes 30*a*, 30*b* are fixed. Therefore, a relative position of each member does not change, and the self pressurization action based on the arc heat is not at all used, and therefore, the pressure and the flow rate of the pressurization gas 35 blown to the arc discharge 4 are also always constant regardless of the electric current condition. Therefore, the flow channel in the insulation nozzle 32 can be designed in an optimum manner so that it becomes ideal for breaking the arc.

(f) Improvement of Breaking Performance During High Speed Reclosing Operation

Further, the intake hole 5 and the intake valve 19 are provided in the pressurization chamber 35, and when the pressure in each chamber becomes less than the filling pressure in the sealed container, the arc-extinguishing gas can be automatically taken in and supplied. As a result, during the turn-on operation, a low temperature arc-extinguishing gas is quickly supplied to the pressurization chamber 35. Therefore, there is no concern about the degradation of the breaking performance even in the second breaking process in the high speed reclosing responsibility.

(Advantage)

As described above, according to the present embodiment, all the problems associated with the conventional gas circuit breaker can be solved at a time. More specifically, according to the present embodiment, the temperature of the blown gas is reduced, and the simple structure is realized, so that the driving operation force can be greatly reduced, and the flow of the arc-extinguishing gas is stabilized, and the gas circuit breaker having not only excellent breaking performance but also durability can be provided.

2. Second Embodiment

A second embodiment has the same basic structure as the first embodiment, but is characterized in a driving device of a movable portion, which is not shown in FIGS. 1A to 1C, 2, and 3.

(Configuration)

Figure 4:
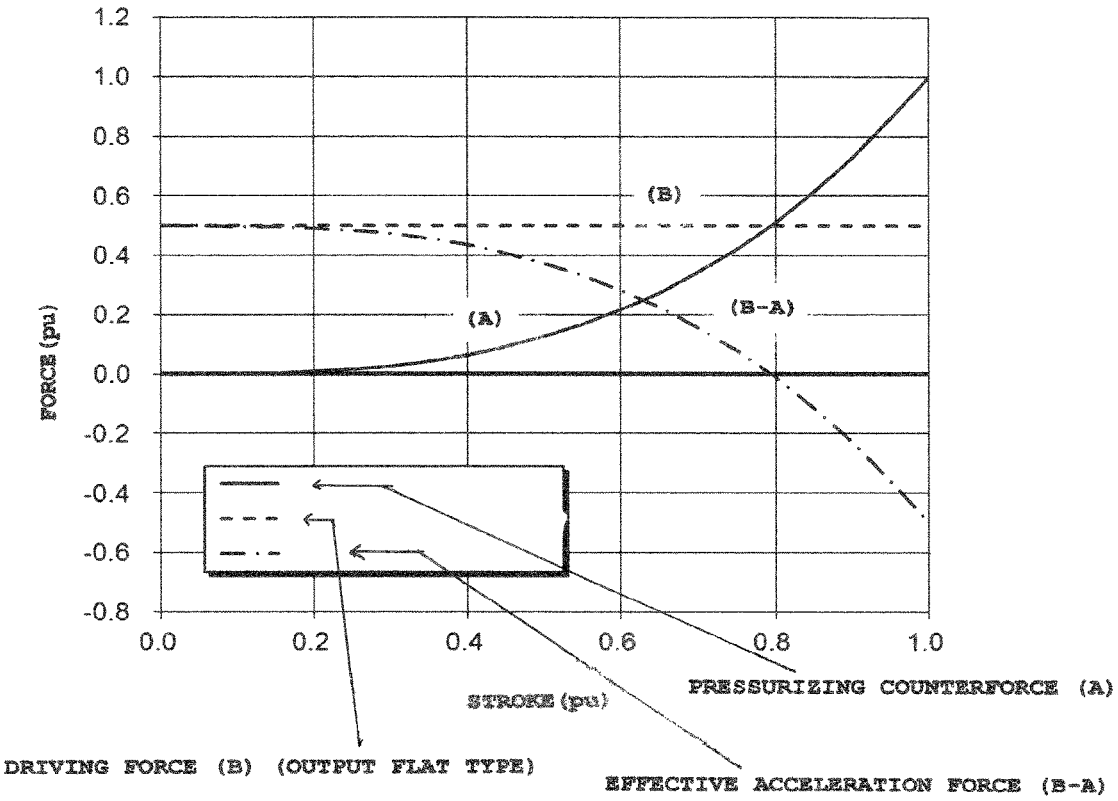
FIG. 4 is a graph illustrating a change of a stroke of a pressurizing counterforce and a movable portion acceleration force in a case of a flat driving output property.
Figure 5:
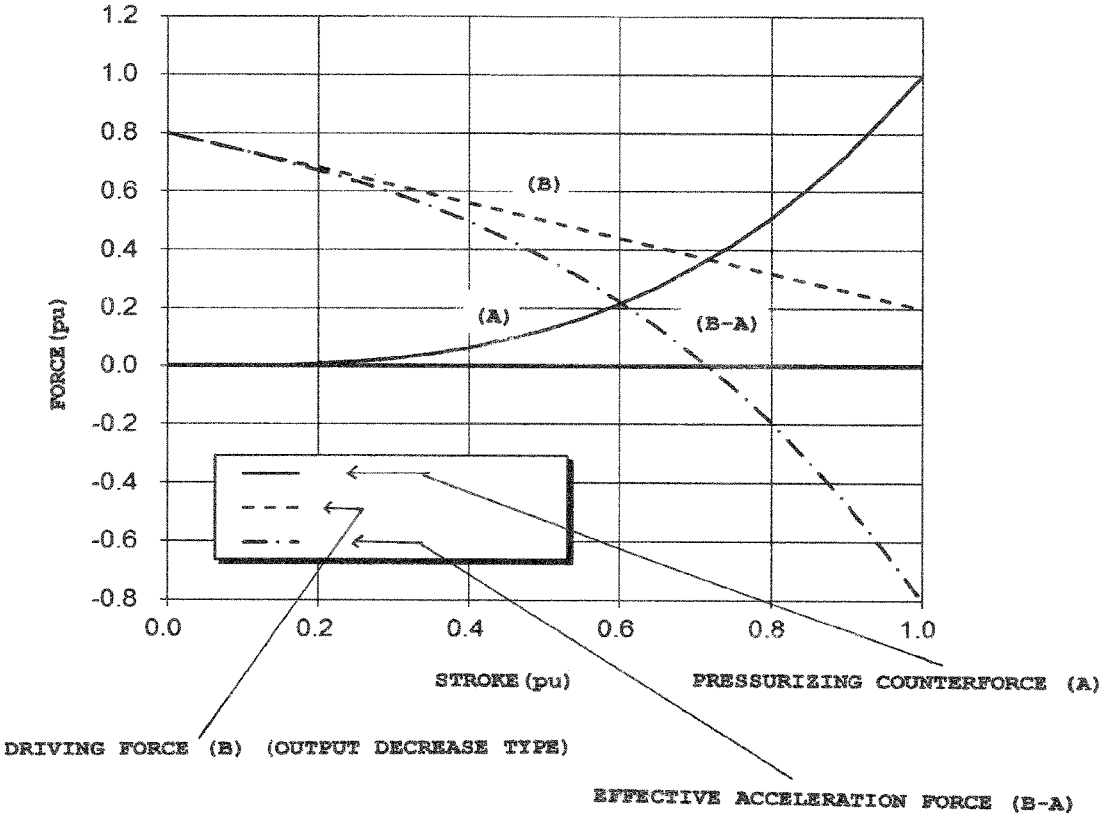
FIG. 5 is a graph illustrating a change of a stroke of a pressurizing counterforce and a movable portion acceleration force in a case of a monotonically decreasing driving output property.

In FIGS. 4 and 5, a pressurizing counterforce (A), i.e., a force received by the movable piston 33 from the pressure of the pressurization chamber 35 is denoted by a solid line, a driving force (B) of the driving device is denoted by a dotted line, and a force for accelerating the movable portion (effective acceleration force, (B−A)) is denoted by alternate long and short dashed lines (chain lines). The horizontal axis is a driving stroke, which is 0 pu at the complete turn-on position, and 1.0 pu at the complete contact parting position. When the effect of friction and the like is disregarded here, the effective acceleration force is drawn by "driving force (B)−pressurizing counterforce (A)". A positive value of the effective acceleration force means an acceleration force, and a negative value thereof denotes a deceleration force.

The gas circuit breaker according to the present embodiment increases the pressure of the blown gas mainly by using heat-insulated pressurizing process with the movable piston 33, and therefore, the curve of the pressurizing counterforce ((A), solid line) becomes a monotonically increasing property as shown in FIGS. 4 and 5 which is known as heat insulating pressurizing property. The heat energy from the art is not utilized in order to increase the pressure of the blown gas, and therefore, the curve of the pressurizing counterforce (solid line) is always constant regardless of the phase of the alternate current and the magnitude of the electric current to be broken.

FIG. 4 illustrates a case where the driving force of the driving device ((B), dotted line) has a flat property in response to a stroke. On the other hand, FIG. 5 illustrates a case where the driving force of the driving device ((B), dotted line) has a property of attenuating in response to a stroke. In the most extreme example, in FIG. 4, the driving force is constant at 0.5 pu over the entire stroke position. On the other hand, FIG. 5 shows a case where, for example, the driving force attenuates in a linear manner from 0.8 pu to 0.2 pu.

The driving device accumulates the driving energy accumulated for the breaking operation is given as the size of area obtained by integrating the driving force ((B), dotted line) with the stroke. More specifically, in the case of the driving force property of FIG. 4, the driving energy is the amount of energy of the following expression.

$$0.5\ \text{pu} \times \text{all stroke } 1\ \text{pu} = 0.5 \qquad \text{(Expression 1)}$$

On the other hand, in the case of the driving force property of FIG. 5, the driving energy is the size of area in a trapezoid enclosed by a line of the vertical axis 0 pu and a dotted line of the driving force (B), and is the amount of energy of the following expression.

$$(0.8\ \text{pu} + 0.2\ \text{pu})/2 \times \text{all stroke } 1\ \text{pu} = 0.5 \qquad \text{(Expression 2)}$$

More specifically, FIGS. 4 and 5 are different in the stroke property of the driving force, but are the same in terms of the driving energy. The second embodiment is characterized in employing the driving device having output attenuation-type as shown in FIG. 5.

(Actions and Effects)

In general, the size and the cost of the driving device tend to monotonically increase according to the driving energy. More specifically, FIGS. 4 and 5 are different in the stroke property of the driving force, but are the same in terms of the driving energy, and therefore, there is no big difference therebetween in the size and the cost of the driving device.

On the one hand, it is understood that the driving device having the property of FIG. 5, in which, with the same the driving energy, a larger driving force is output in the first half of the stroke and it attenuates toward the latter half thereof, has a larger value of effective acceleration force (B−A) than that in FIG. 4. In FIGS. 4 and 5, the property (A) of the pressurizing counterforce is the same, and the driving energy is also the same, and therefore, the speed at the complete contact parting position (stroke 1 pu) is also the same, however, the speed during the stroke is different between FIGS. 4 and 5, and the top speed of the movable portion is faster in FIG. 5 in which the acceleration force is larger in the first half of the contact parting process.

This indicates that when the operation driving energy is the same, the driving device having the output attenuation-type driving property as shown in FIG. 5 can increase the driving speed of the movable portion more greatly than the driving device having the driving property of FIG. 4. This means that, for the gas circuit breaker, the gap between the electrodes opens in a shorter time, and this is advantageous in terms of recovery of the electrical insulation between the electrodes in a shorter time. When the driving speed of the movable portion becomes faster, it takes less time from when the arc discharge 4 moves from the trigger electrode 31 onto the fixed arc electrode 30*b* to when the low temperature pressurized gas is strongly blown to the arc discharge 4 from the pressure accumulation chamber 36, and this results in a shorter time to complete breaking, and further results in improvement of the durability.

The acquisition of the actions and effects explained above derives from the fact that the gas circuit breaker increases the pressure of the blown gas by mainly performing the heat insulating pressurizing process (adiabatic compression process) with the movable piston 33, and for this reason, the gas circuit breaker has such a property that the pressurizing counterforce is extremely small at first, and increases rapidly toward the latter half thereof. The property of the pressurizing counterforce in a curve that is constant at all times regardless of the phase of the alternate current and the magnitude of the electric current to be broken is an essential condition for obtaining the actions and effects explained above. Any of the above cannot be achieved with a structure of a conventional gas circuit breaker. This is because, in the conventional circuit breaker, the pressurizing counterforce applied to the fixed piston 15 is greatly affected by the heat generated by the arc, and therefore, it is not in a monotonically increasing curve, and the aspect is greatly different according to the condition of the break electric current.

A specific method to make the driving output into the attenuation-type property as shown in FIG. 5 from the flat property as shown in FIG. 4 where the driving energy is the same condition will be explained. This can be easily achieved when a spring accumulating force is employed as the driving energy source. In principle, the output property of the spring mechanism is given as shown in the following expression, and is in a monotonically decreasing straight line as shown in FIG. 5.

$$F = -k \cdot x \qquad \text{(Expression 3)}$$

In this case, F denotes a driving force, k denotes a spring constant, and x denotes a stroke.

In particular, when the spring is configured to be the free length at the complete contact parting position (stroke 1 pu), the spring has such a property that the value of the spring constant k increases, and when the spring is released, the driving force attenuates greatly with respect to the stroke.

Alternatively, in a case of using a driving device having a relatively flat output property in response to a stroke like a hydraulic operation mechanism, an appropriate link structure is coupled, so that the output property can be changed into the attenuation type without changing the operation driving energy.

Various other methods for making the output property into the attenuation type other than the method explained above may be considered, but the important thing is that, in the structure as shown in the first embodiment, when combined with a mechanism in which the driving force is attenuation type in response to the stroke, the separation speed of the electrodes can be effectively increased even with the same operation driving energy, but this can obtain particular advantages such as improvement of the durability and the reduction of the time taken to quickly recover the insulation of the circuit breaker and complete the breaking.

Further, a high gas pressure of the pressurization chamber 36 explained in the first embodiment is separated from the movable piston 33, and the pressure of the pressurization chamber 35 is released by the pressure release mechanism 48, so that even when the driving force greatly decreases in the latter half of the contact parting process, a disadvantage such as reverse movement of the movable portion would not occur. It should be noted that, as one of the standards of the output reduction type driving force property, it is suggested that the driving force at the complete breaking position (stroke 1 pu) is, for example, approximately 80% or less than the driving force of the turn-on position (stroke 0 pu). When the output reduction rate at the complete contact parting position is set to be equal to or less than 80%, the above actions and effects can be substantially obtained.

3. Other Embodiments

In this specification, the embodiments according to the present invention have been explained, but the embodiments are presented as an example, and are not intended to limit the scope of the invention. The embodiments include those including all or any one of the configurations disclosed in the embodiments. The above embodiments can be carried out in various other forms, and various kinds of omission, replacement, and change can be applied without deviating from the scope of the invention. The embodiments and the modifications thereof are included in the scope and the gist of the invention, the embodiments and the modifications thereof are included in the invention described in the claims and the scope equivalent thereto.

What is claimed is:

1. A gas circuit breaker for switching breaking and turning-on of an electric current, comprising:

a sealed container filled with an arc-extinguishing gas;

a pair of fixed arc electrodes arranged in said sealed container to be opposite to each other;

a trigger electrode movably arranged between said fixed arc electrodes and generating an arc discharge according to movement;

a pressurization chamber that increases pressure of said arc-extinguishing gas, a pressure accumulation chamber in communication with said pressurization chamber and accumulating said pressurized arc-extinguishing gas; and wherein said trigger electrode is an open and close section for switching said pressure accumulation chamber into a closed state or an open state, and said pressure accumulation chamber is switched to said closed state in a first half of breaking of said electric current, and said pressure accumulation chamber is switched to said open state in a latter half of breaking of said electric current, so that said arc-extinguishing gas in said pressure accumulation chamber is guided to said arc discharge, wherein said pressurization arc-extinguishing gas is blown out from an inside of one of said fixed arc electrodes to an outside thereof.

2. The gas circuit breaker according to claim 1, wherein said pressurization chamber further comprises a pressure release mechanism for releasing said pressure of said pressurization chamber in accordance with movement in which said pressurization chamber moves to a position where said communication portion is sealed.

3. The gas circuit breaker according to claim 1, wherein said pressurization chamber further comprises a driving device for mechanically pressurizing said arc-extinguishing gas, wherein a driving force of said driving device decreases when said pressure of said pressurization chamber is released.

4. The gas circuit breaker according to claim 1, wherein said pressurization chamber synchronizes with said trigger electrode, and said driving device for moving said trigger electrode and a driving device for mechanically pressurizing said arc-extinguishing gas with said pressurization chamber are common.

5. The gas circuit breaker according to claim 1, wherein said pressurization chamber comprises a cylinder and a piston integrally provided with said cylinder, wherein said piston is arranged slidably in said cylinder, and said pressure of said arc-extinguishing gas in said cylinder does not increase by heat of said arc discharge.

6. The gas circuit breaker according to claim 1, further provided with an insulation nozzle fixed between said pair of fixed arc electrodes, wherein said arc-extinguishing gas of which temperature has been raised by said arc discharge is adjusted by said insulation nozzle.

7. The gas circuit breaker according to claim 1, wherein said pressurization chamber seals a communication portion between said pressurization chamber and said pressure accumulation chamber in accordance with movement, and separates said pressurization chamber and said pressure accumulation chamber in terms of pressure.

8. The gas circuit breaker according to claim 7, wherein said pressurization chamber further comprises a pressure release mechanism for releasing said pressure of said pressurization chamber in accordance with movement in which said pressurization chamber moves to a position where said communication portion is sealed.

9. The gas circuit breaker according to claim 7, wherein said pressurization chamber further comprises a driving device for mechanically pressurizing said arc-extinguishing gas, wherein a driving force of said driving device decreases when said pressure of said pressurization chamber is released.

10. The gas circuit breaker according to claim 7, wherein said pressurization chamber synchronizes with said trigger electrode, and said driving device for moving said trigger electrode and a driving device for mechanically pressurizing said arc-extinguishing gas with said pressurization chamber are common.

11. The gas circuit breaker according to claim 7, wherein said pressurization chamber comprises a cylinder and a piston integrally provided with said cylinder, wherein said piston is arranged slidably in said cylinder, and said pressure of said arc-extinguishing gas in said cylinder does not increase by heat of said arc discharge.

12. The gas circuit breaker according to claim 7, further provided with an insulation nozzle fixed between said pair of fixed arc electrodes, wherein said arc-extinguishing gas of which temperature has been raised by said arc discharge is adjusted by said insulation nozzle.

* * * * *